United States Patent [19]

Rutsche et al.

[11] 4,422,385

[45] Dec. 27, 1983

[54] OFFICE FURNITURE

[75] Inventors: Wendolin Rutsche, Ruti; Urs Langenegger, Hittnau, both of Switzerland

[73] Assignee: Embru-Werke, Mantel & Cia., Ruti, Switzerland

[21] Appl. No.: 211,031

[22] Filed: Nov. 28, 1980

[51] Int. Cl.[3] ..... A47B 3/06

[52] U.S. Cl. ..... 108/153; 108/23; 108/111; 108/150; 312/194; 312/257 SK

[58] Field of Search ..... 312/223, 194, 257 SK, 312/257 A, 195; 52/220, 221; 108/23, 153, 150, 33, 111

[56] References Cited

U.S. PATENT DOCUMENTS

| | | | |
|---|---|---|---|
| 594,998 | 12/1897 | Lyle | 52/221 X |
| 2,510,255 | 6/1950 | Robb | 312/194 |
| 3,623,435 | 11/1971 | Ferdinand et al. | 312/257 SK |
| 3,635,174 | 1/1972 | Ball et al. | 108/23 X |
| 3,647,274 | 3/1972 | Schnelle | 312/257 SK |
| 3,770,334 | 11/1973 | Weber | 312/194 X |
| 3,833,279 | 9/1974 | MacKenzie, Jr. | 312/257 SK |
| 3,866,550 | 2/1975 | Geschwender | 108/153 |
| 3,877,395 | 4/1975 | Sobel | 108/153 |
| 4,045,911 | 9/1977 | Ware | 108/23 |
| 4,066,305 | 1/1978 | Grazarek | 312/223 X |
| 4,094,561 | 6/1978 | Wolff et al. | 312/223 |
| 4,163,867 | 8/1979 | Breidenbasch | 312/223 X |
| 4,296,981 | 10/1981 | Hilderbrandt et al. | 312/194 |
| 4,323,291 | 4/1982 | Ball | 312/194 |

FOREIGN PATENT DOCUMENTS

| | | | |
|---|---|---|---|
| 2048351 | 12/1980 | United Kingdom | 312/257 SK |

*Primary Examiner*—James T. McCall

*Attorney, Agent, or Firm*—Kinzer, Plyer, Dorn & McEachran

[57] ABSTRACT

The office furniture item is provided with at least two lateral parts (1) interconnected by a connective support (21). The lateral parts (1) and the connective support (21) are provided with a continuous cavity. Each lateral part (1) comprises a core element (2) with a supporting column (6) from which a leg part (5) and a supporting arm (7) protrude. The core element (2) is provided with recesses (9,10,11) which are at least partly sealed by the cover means (3,4,16). The office furniture item is appropriate for the working station design in modular design. Signal cables and electrical conduits can be inserted at any time without any problem. They are invisible from the outside.

10 Claims, 10 Drawing Figures

1
2
3
4
5
6
7
8
9
10
11
12
13
14
15
16
16a
17
18
19
20
21
22
23
39
40
61
62

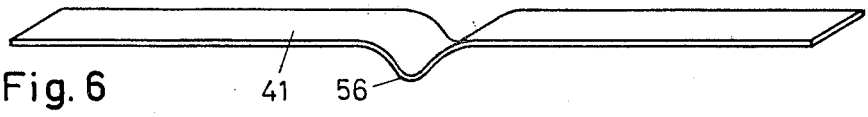
Fig. 6
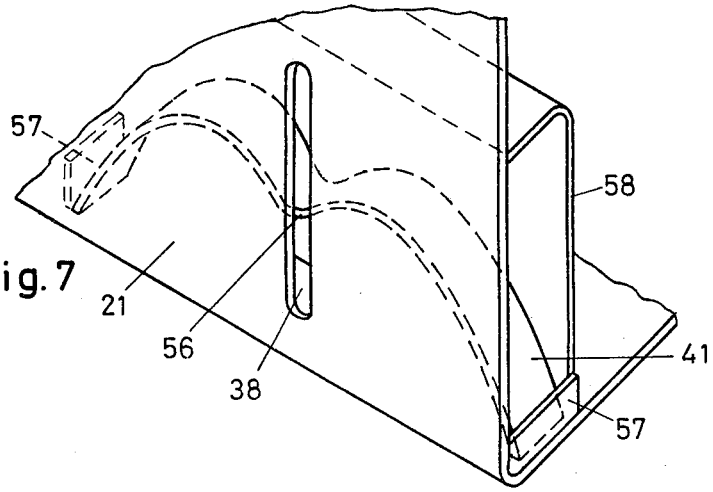
Fig. 7
Fig. 8
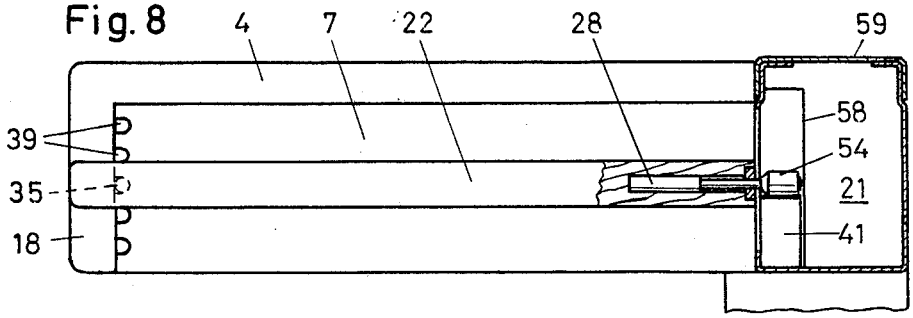
Fig. 9
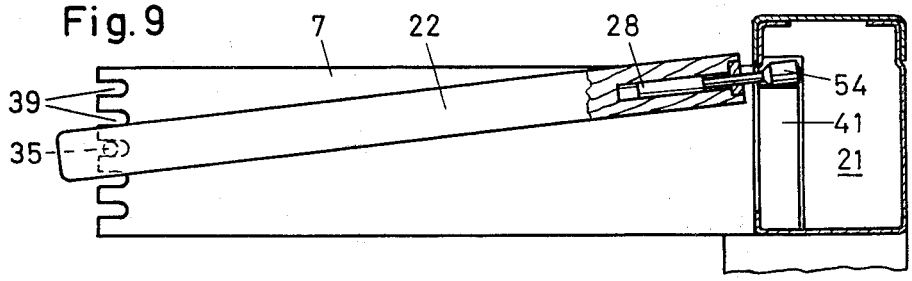
Fig. 10
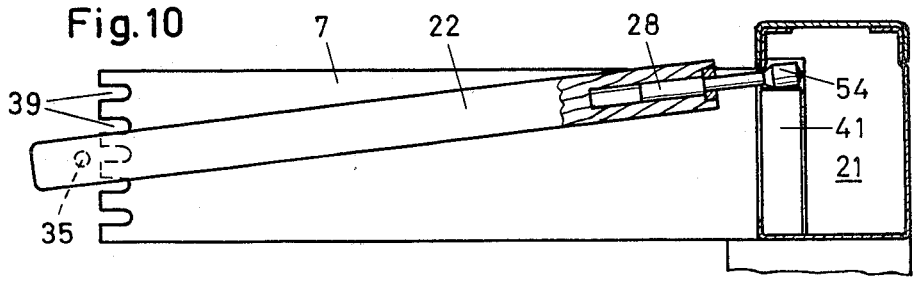

OFFICE FURNITURE

The invention relates to a furniture item for the design of operating stations in modular design, whereby the item of furniture is provided with at least two lateral parts interconnected by a connective support.

For modern operating station design office furniture units are used nowadays which are built up from several basic elements and which can be assembled and dismantled in modular design. Depending on the application of the furniture item, telephones, lamps, data viewing instruments, signal keyboards, etc. must be integrated into the furniture item. According to prior art this was impossible to do this in a simple and aesthetically satisfactory manner, and the invention therefore is based on the problem of remedying this situation.

This is done according to the invention in that the lateral parts and the connecting supports from a continuous cavity, that each lateral part consists of a core element with a supporting column and a leg part spaced away from this column, and a supporting arm, and that the core element is provided with recesses which are lockable at least in part by coverings.

With the item of furniture it is possible at all times to install signal cables and electrical conduits without them being visible from the exterior. No transverse ribs which could complicate the installation of conduits are present in the interior area of the lateral parts and the connective carrier or support.

BRIEF DESCRIPTION OF THE DRAWINGS

Embodiments of the invention are explained below in greater detail, by way of the drawings.

FIG. 6 shows the leaf spring for the table top support in unbiased condition;

FIG. 7 shows in perspective a cutout from the central area of the connecting support with the leaf spring in biased condition drawn in broken lines; and FIGS. 8 and 10 represent a section along line VIII—VIII according to FIG. 3, showing different possibilities of the vertical and tilt adjustment of the table top.

Figures 1, 2:
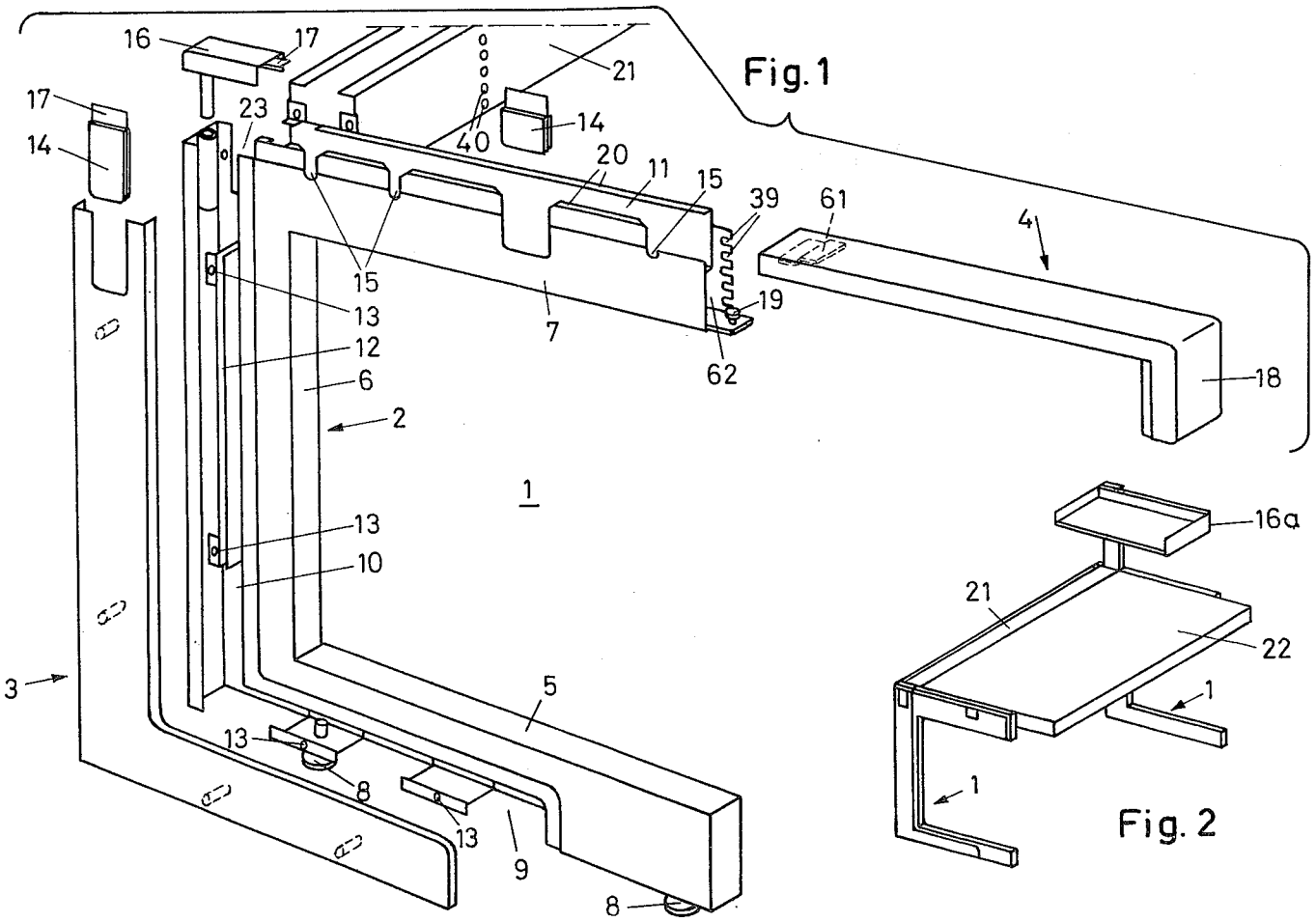
FIG. 1 represents a view in perspective of one lateral part and of one connective support in extended representation.
FIG. 2 is a view in perspective of an office desk.
Figure 3:
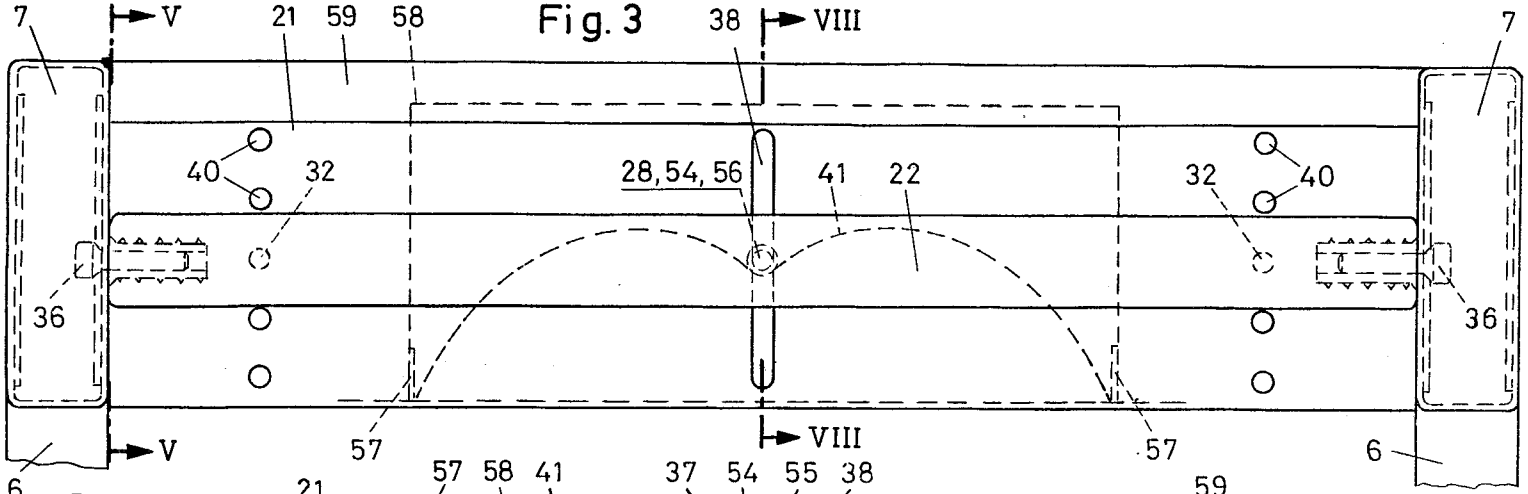
FIG. 3 is a view from the front upon the top part of the office desk according to FIG. 2, on an enlarged scale, and without the plug-in unit.
Figure 5:
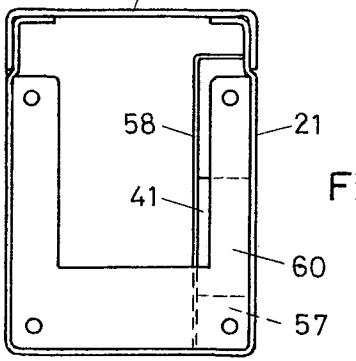
FIG. 5 is a front view upon the end of the connective support.
Figure 4:
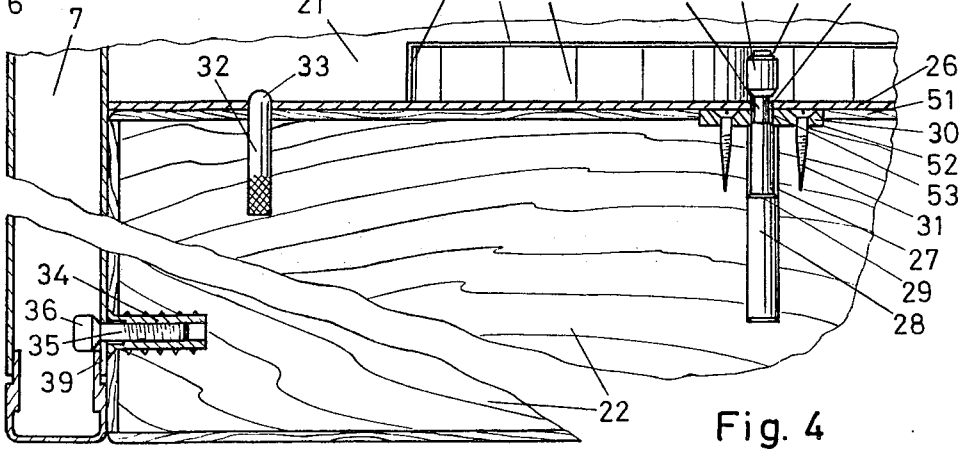
FIG. 4 is a view from the top on part of the office desk, sectioned according to FIG. 3.

The lateral part 1 represented in FIG. 1 in perspective is made of sheet metal and forms the principal element of an office furniture system for an efficient design of a working station. The lateral part 1 comprises a U-shaped core element 2 as well as a lateral and upper cover panels 3 and/or 4.

The principal element 2 is designed as a partly open hollow profile, with the lower leg of the "U" forming the leg of the office furniture (leg 5). The leg 5 transcends into a vertical supporting column 6 from which a carrier arm 7 protrudes horizontally. The carrier arm 7 is the second leg of the "U". Vertically adjustable supporting screws 8 are arranged at the leg 5 in a manner known per se from prior art.

The leg 5 has a recess 9 on the one side and downwardly. The supporting column 6 likewise is provided laterally with a vertically extending aperture 10. Finally, the carrier arm 7 has on top a slot-like recess 11 through which its interior area is accessible from the top.

The recesses in the core element 2 permit in a simple manner the insertion of electrical cables and signal conduits without loops into the lateral part 1. The subdivision 12 of the inner duct 10 of the supporting column 6 is used to separate the electric conduits having high voltage from the signal conduits of low voltage.

Following the pulling in of the cables and/or conduits it is possible to cover the lateral openings in the leg 5 and in the supporting column 6 by the L-shaped cover panel 3.

The cover panel 3 is connected via snap-in pins and snap holding means 13 to the core element 2 and thus can simply be pressed on to the latter.

A slide 14, inserted on top in the lateral cover panel 3, can be removed if additional units of furniture are to be added at the lateral part. By removing the slide 14, the access to the conduits and cables in the interior of the core piece 2 is exposed so that these conduits etc. can be pulled into the second piece of furniture without any problem. A removable slide is likewise arranged in the supporting arm 7 and serves the same purpose.

The additional units of furniture are fastened in a manner not shown in detail via clamping screws, which are inserted into the grooves 15 which are open on top, at the core element 2 of the lateral part 1. Because of the slides 14, the current and signal cable connections can be placed invisibly from the outside in the piece of furniture.

The supporting column 6 is provided with a sealing cover 16 which covers a protruding flap 17 of the slide 14 of the cover panel 3 and thus secures it against unauthorized removal. The sealing cover 16 in turn is likewise provided with a flap or tab 17 which grips beneath the upper covering 4, so that the sealing cover 16 can be removed only following removal of the upper covering 4. It would be possible to mount in place of the sealing cover 16 a plugable unit, for example, a lamp or a standardized element **16*a*** on the supporting column.

To seal the carrier arm 7 the upper covering 4 is inserted from the forefront of the carrier arm until it snaps with its end 18 into a snap fastening means 19 at the forefront of the carrier arm 7. The covering means 4 grips with a flap 61 into the inwardly protruding rails 20 and is guided through the latter. As a result of the upper covering means 4, the slides 14, the sealing cover 16 or a corresponding plugable unit as well as possibly present clamping screws are secured in the grooves 15. In addition the lateral engagement pins in the table top are likewise held firmly in a manner to be described as yet.

To build up the desk, two lateral parts 1, one upper connecting support 21 and one table top 22 are needed (FIG. 2). The connective support 21 sealed by a covering profile 59 is designed as a U-profile and has at both ends a flange 60 which is pushed against the supporting columns of the lateral parts and connected to them by means of screws. The upper inner lateral apertures 23 in the supporting columns expose the access to the inner area of the support 21, so that it is possible again to pull in electrical cables and signal conduits. The design of the inner area of the support is such that electrical receptacles and distribution boxes can be installed without any problem.

The table top 22 is made from wood which is coated for example with a veneer 50 or with plastic and framed by marginal strips 51. A perforation 27 is applied in the center at the posterior table top edge 26, a guide bolt 28 being positioned movably therein.

The bolt 28 is manufactured as one piece and as a rotary part, with the rear section having a larger diameter than the front section. The transition between the front and the rear section forms a stop 29 which co-acts with a metallic holding means 30.

With the assembly, the bolt 28 first is pushed into the perforation 27 and the holding means 30 is fastened by means of the screws 31 at the table top edge 26. The holding means 30 is placed in a recess 52 and flush with the table top edge.

The bolt 28 can be pulled out only until the stop 29 hits against the holding means 30 whose perforation 53 is slightly larger than the diameter of the anterior bolt section, but smaller than the diameter of the posterior bolt section.

Each pin 32 with a protruding head 33 is anchored at both sides of the guiding bolt 28 in the rear edge 26 of the table top 22, for example by being glued into a perforation. Each bushing 34 is pounded in at the anterior area of the lateral table top edges, a threaded bolt 35 with protruding head 36 being screwed into said bushing.

For the mounting of the table top 22 first the protruding front end 37 of the movable bolt 28 is inserted into a vertical slot 38 in the connecting support 21. Subsequently, the head portion 54 is loosely pushed from the interior side of the connecting support upon the frontal end 37 and secured by means of a safety ring 55. Now the movable bolt 28 is held securely in the vertical slot. Now the table top 22 can be pulled forwardly until the stop 29 of the bolt 28 is seated at the holding means 30.

As the table top 22 is pushed rearwardly against the connecting support 21, the lateral bolt heads 36 are engaged into one of the engagement grooves 39 of the forefront of the supporting arm 7. At the same time, the pin heads 33 of the rear edge 26 are pushed into one of the superimposed perforations 40 in the connecting support 21.

The head part 54 of the bolt 28 rests in a leaf spring 41 accommodated in the interior of the support 21, and thus compensates for part of the weight of the table top.

The oblong leaf spring 41 which is oblong in unloaded condition (FIG. 6) has a central recess 56 in which the head part 54 comes to rest. The spring is inserted loosely into the interior of the connecting support 21 and then tensioned arcuate-like between two terminal stops 57. The lateral holding of the spring 41 is assured by a panel 58. As shown from FIGS. 8 to 10, the table top can be adjusted vertically and/or angularly in a simple manner. To do this, first the upper coverage means 4 are disengaged and pushed slightly forward, in order to release the grooves 39 in the carrier arm 7. Then the table top can be pulled forward until it is disengaged completely and only suspended via the movable bolt 28 at the support 21, with the leaf spring 21 bearing part of the weight of the table top. It is impossible to erroneously release the table top because the bolt head 54 grips behind the vertical slot.

Now the table top is placed into the desired height and tilt and then pushed again rearwardly, so that it will again engage laterally and in the rear. Finally the upper covering means 4 of the supporting arms 7 are pushed in again to secure the lateral engagement pins. FIGS. 8 to 10 show three different possibilities of adjustment.

The office furniture unit according to the invention assures a measure of system flexibility which heretofore has not been attained. The design and the linkage members can be mounted and again be removed with a few manipulations. Besides the vertical adjustability the table tops also can be inclined forwardly with a few, but important degrees, a factor which industrial medicine considers as very favorable.

It also is possible to replace the table tops without screws in a matter of seconds, in order to adapt working stations to new requirements. Different plug-on units, like manuscript holders, telephones and letter tray assemblies as well as lighting fixtures for operating stations can be plugged on rapidly on the supporting column and/or the connecting duct. Signal cables and electric conduits can always be introduced into the unit of furniture without any problems and they are invisible from the outside.

For example, it also is possible to plug extensions in the front into the supporting arm. For that purpose, the interior area of the supporting arm is subdivided, with the duct 62 being used as a guide means for a profiled part which forms part of the extension. In this variant of an embodiment the cover means 4 also must be designed longer and/or the end 18 would have to be eliminated.

Selectively, it is possible to suspend or attach containers in the piece of furniture or push them beneath the piece of furniture as containers with pivotal rollers.

The item of furniture permits in a simple manner the designing of individual or multiple person offices, as well as of functional areas or office scenery.

We claim:

1. Furniture in a modular design for setup at the work place, such that the modular unit has at least two generally U-shaped side parts connected by a transverse connecting beam, and each side part consists of a hollow upright column support with a projecting arm support and a projecting foot piece, characterized by the fact that at least the column support (6), the arm support (7) and the connecting beam (21) form a closable cable-carrying channel which allows uninterrupted access from the outside, and part of the channel in the arm support (7) is shaped in the form of a longitudinal slit (11) that is open at the top and is covered by a separate, displaceable covering strip (4) which is slidably inserted from the front inwardly toward the connecting beam, that the channel also runs through the foot piece, and wherein a vertical recess (10) in the column support (6) and a horizontal recess (9) in the foot piece (5) are closed by a displaceable L-shaped side cover (3).

2. Furniture according to claim 1, characterized by the fact that there are displaceable slides (14) in the upper part of the side cover (3) and in the supporting arm (7) to provide uninterrupted access to the interior of the side part when attaching other furniture elements, and the slides (14) have tabs (17) which slidably fit within the covering strip (4) so that the slides (14) are secured by the covering strip (4).

3. Furniture according to claim 2, characterized by the fact that a cover plate (16) or a plug-in-unit (16*a*) for lamps, add-on elements and the like are provided at the top open end of the column support (6), and the cover plate (16) and the plug-in-unit (16*a*) have tabs (17) that fit under the covering strip.

4. Furniture according to claim 1, characterized by the fact that the connecting beam (21) has a U-shaped cross section, is open at both ends, is attached to the side parts, is closed at the top by a removable cover (59), and its interior space is connected through openings (23) in the side parts with the inside space of the latter.

5. Furniture according to claim 3, characterized by the fact that the inside space of the arm support (7) is subdivided and has a guide channel (62) to receive an extension piece, and further characterized in that the covering strip (4) is provided on the inside with a flap (61) which grips rails (20) provided on the arm support (7).

6. Furniture according to claim 1, characterized by the fact that grooves (15) which are open at the top and are at least partially covered by the covering strip (4) are provided in the arm support to receive mounting elements for attaching additional furniture parts.

7. Furniture according to claim 1 in which the bent end of the covering strip (4) engages a snap fastener at the forefront of arm support (7).

8. Furniture in a modular design for setup at the work place, such that the modular unit has at least two generally U-shaped side parts connected by a transverse connecting beam, and each side part consists of a hollow upright column support with a projecting arm support and a projecting foot piece, characterized by the fact that at least the column support (6), the arm support (7) and the connecting beam (21) form a closable cable-carrying channel which allows uninterrupted access from the outside, and part of the channel in the arm support (7) is shaped in the form of a longitudinal slit (11) that is open at the top and is covered by a separate, displaceable covering strip (4) which is slidably inserted from the front inwardly toward the connecting beam, and that the front of the covering strip (4) is bent downwardly at an angle, so that the bend (18) forms the end of the front of the arm support (7).

9. Furniture in a modular design for setup at the work place, such that the modular unit has at least two generally U-shaped side parts connected by a transverse connecting beam, and each side part consists of a hollow upright column support with a projecting arm support and a projecting foot piece, characterized by the fact that at least the column support (6), the arm support (7) and the connecting beam (21) form a closable cable-carrying channel which allows uninterrupted access from the outside, and part of the channel in the arm support (7) is shaped in the form of a longitudinal slit (11) that is open at the top and is covered by a separate, displaceable covering strip (4) which is slidably inserted from the front inwardly toward the connecting beam, and by the fact that there are grooves (39) which are open at one side and are aligned in rows one above the other in the front of the arm support (7) to receive projecting bolts (35) of a table top (22), so that the bolts (35) are secured by the covering strip (4).

10. Furniture in a modular design for setup at the work place, such that the modular unit has at least two generally U-shaped side parts connected by a transverse connecting beam, and each side part consists of a hollow upright column support with a projecting arm support and a projecting foot piece, characterized by the fact that at least the column support (6), the arm support (7) and the connecting beam (21) form a closable cable-carrying channel which allows uninterrupted access from the outside, and part of the channel in the arm support (7) is shaped in the form of a longitudinal slit (11) that is open at the top and is covered by a separate, displaceable covering strip (4) which is slidably inserted from the front inwardly toward the connecting beam, and by the fact that the foot piece (5) is open at the bottom to be accessible from beneath for introducing lines and cables.

* * * * *